United States Patent [19]

Goldstein

[11] Patent Number: 4,752,045

[45] Date of Patent: Jun. 21, 1988

[54] REUSABLE INSERTABLE ONE-PIECE HANDLE FOR STRETCH WRAP ROLLS

[76] Inventor: Joseph Goldstein, 1700 Palisades Dr., Pacific Palisades, Calif. 90272

[21] Appl. No.: 922,266

[22] Filed: Oct. 23, 1986

Related U.S. Application Data

[63] Continuation-in-part of Ser. No. 912,979, Sep. 29, 1986.

[51] Int. Cl.[4] ..... B65H 16/06; B65H 19/12

[52] U.S. Cl. ..... 242/68.4; 242/72 R; 242/96

[58] Field of Search ..... 242/96, 99, 75.4, 72 R, 242/68.4, 129.51, 156, 68.6, 68.2

[56] References Cited

U.S. PATENT DOCUMENTS

| | | | |
|---|---|---|---|
| 1,292,361 | 1/1919 | Obermiller | 242/96 |
| 2,537,613 | 1/1951 | Allen | 242/96 X |
| 3,627,220 | 12/1971 | Vogel | 242/68.6 |
| 4,179,081 | 12/1979 | Parry | 242/96 X |
| 4,248,392 | 2/1981 | Parry | 242/96 |
| 4,372,500 | 2/1983 | Saraisky | 242/96 X |
| 4,477,037 | 10/1984 | Goldstein | 242/96 X |
| 4,484,717 | 11/1984 | Goldstein | 242/96 |
| 4,575,020 | 3/1986 | Strout et al. | 242/96 |

*Primary Examiner*—Stuart S. Levy
*Assistant Examiner*—Joseph J. Hail, III
*Attorney, Agent, or Firm*—Allan M. Shapiro

[57] ABSTRACT

Two identical handles are configured for insertion into the core of a stretch-wrap roll. A substantially rigid hand grip is forward on each handle so that the hand grips can be grasped in the two hands for position guidance of the stretch-wrap roll. The handle grips can be carried in the gloved hand and can be run free or squeezed for braking control during stretch-wrap film winding. Each handle is molded of synthetic polymer composition material to be sufficiently rigid to provide the necessary support, but the plug inserted into the core is configured and sized to be somewhat resilient to facilitate insertion into and removal from the core.

16 Claims, 1 Drawing Sheet

FIG. 1.
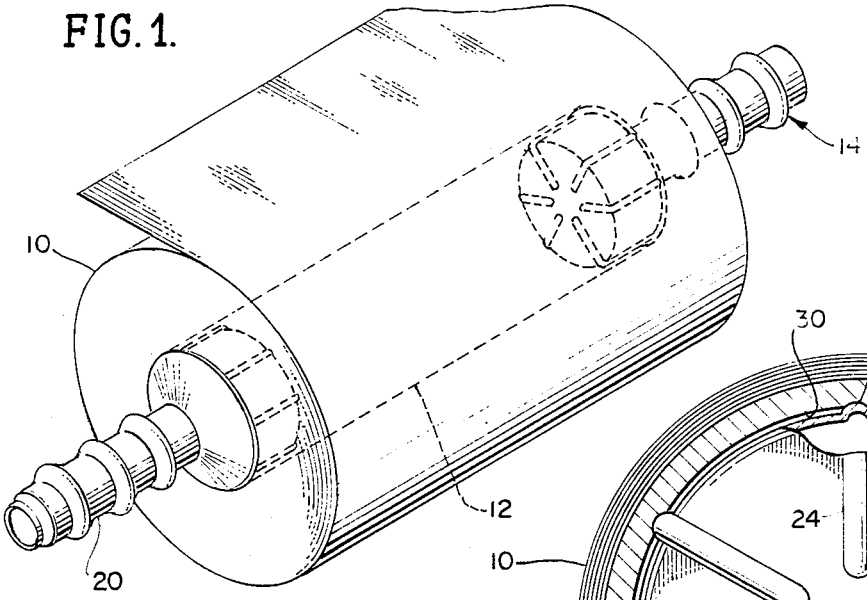
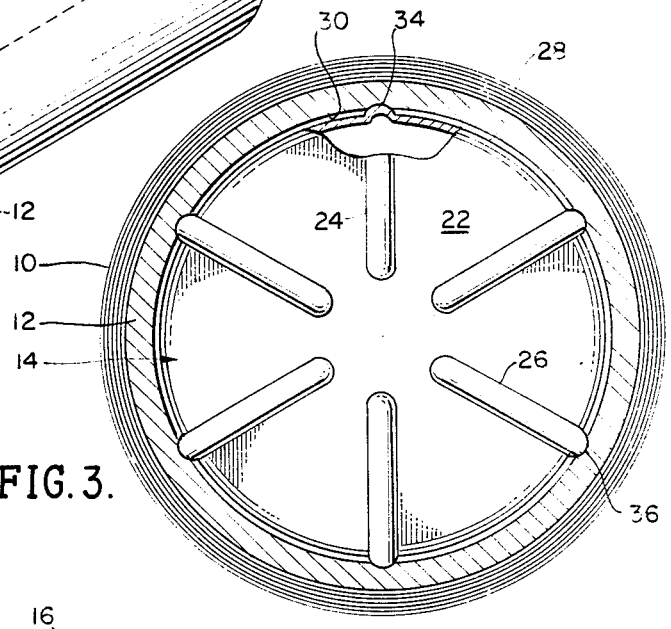
FIG. 3.
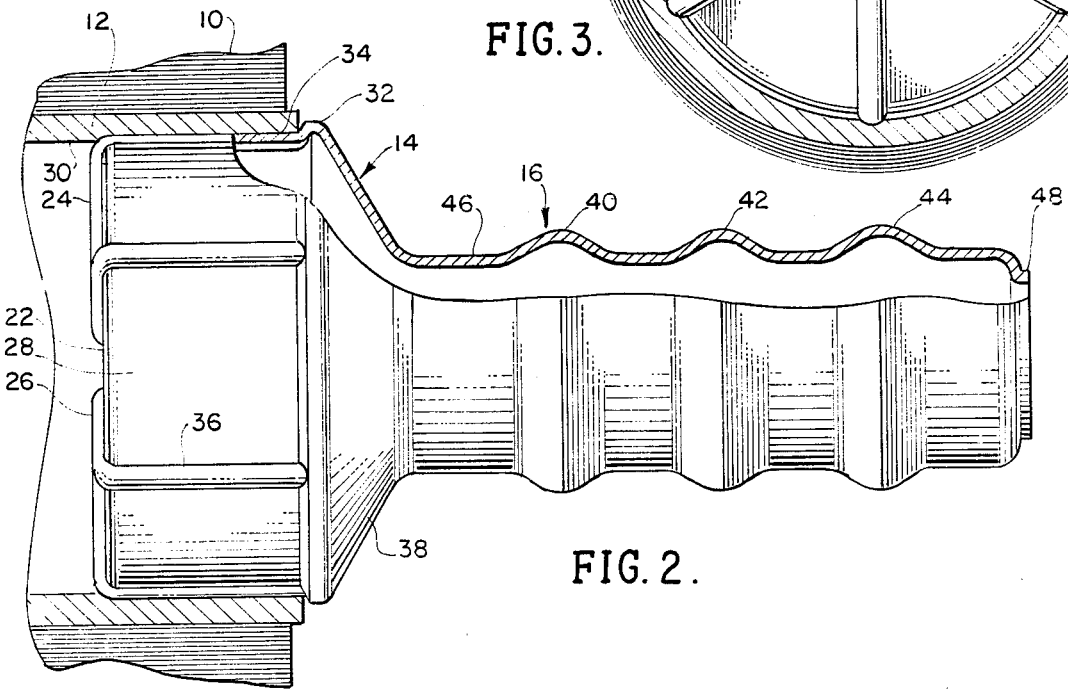
FIG. 2.
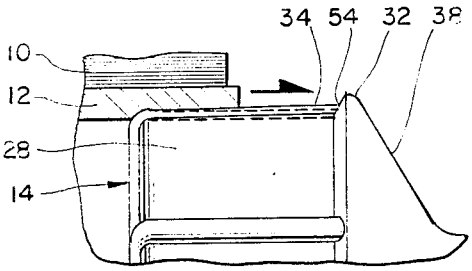
FIG. 4.
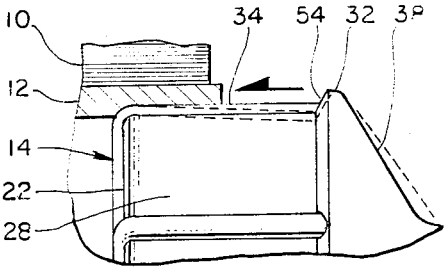
FIG. 5.

REUSABLE INSERTABLE ONE-PIECE HANDLE FOR STRETCH WRAP ROLLS

CROSS REFERENCE

This is a continuation-in-part of my prior application, Ser. No. 912,979, filed Sept. 29, 1986 entitled "Reusable Insertable Handle for Stretch Wrap Rolls," the entire disclosure of which is incorporated herein by this reference.

BACKGROUND OF THE INVENTION

This invention is directed to a pair of handles which can be inserted into the ends of a standard core upon which stretch-wrap film is wrapped so that the handles can guide the roll during wrapping and provide the desired wrapping tension.

Stretch-wrap film is a resilient synthetic polymer composition film, usually transparent, which can be used for wrapping. One particular type of wrapping for which it is especially suitable is the wrapping together of a plurality of packages into a larger wrapped unit. If a plurality of packages is stacked on a pallet, the packages can be wrapped both to provide weather protection and to wrap them into a unitary structure which is less likely to break down during transport of the pallet. In the final stage of manufacturing the film, it is wound upon a core which is usually in the form of a cylindrically tubular cardboard core. When wound on such a core, the film can be stored, transported and made ready for use.

There are a number of machines on the market which rotate a pallet load of packages to wind stretch-wrap film thereabout. Additionally, the present inventor, Joseph Goldstein, has produced machines which carry a roll of stretch-wrap film around material to be wrapped into a unit. However, when the wrapping volume is sufficiently low that the wrapping machine cannot reasonably be utilized, stretch-wrap rolls are carried by hand around the load to be wrapped. J. C. Parry teaches in his U.S. Pat. No. 4,179,081 that the stretch-wrap film can be rewound onto a core that extends from the roll of stretch-wrap film, and this extended core can be manually engaged for guiding the roll around the material to be wrapped, including tensioning of the roll. In that case, he requires that both of the user's hands must be involved in the control of the tension. In addition, J. C. Parry teaches in his U.S. Pat. No. 4,248,392 that insertable handles can be employed in engagement in the tubular core upon which the film is factory-wrapped. In this case, he specifically teaches that the inserts are of such nature as to not damage the core.

There continues to be need for a handle which is insertable into the core of a stretch-wrap roll and can be removed therefrom so as to be usable, with the handle being constructed so that it can be readily inserted into the end of the core, firmly engage in the core, and be easily removable from the core for reuse. It is desirable that such a reusable handle be configured so that each handle is identical and of one piece for economy of distribution and ease of manufacture.

SUMMARY OF THE INVENTION

In order to aid in the understanding of this invention, it can be stated in essentially summary form that it is directed to a reusable insertable one-piece handle for stretch-wrap rolls wherein the handle carries an insertion plug thereon configured so that it can engage in, grasp and be removable from the core of a stretch-wrap roll together with a hand grip integrally informed thereon for manual grasp.

It is, thus, an object and advantage of this invention to provide a reusable insertable handle for stretch-wrap rolls which can be employed in connection with rolls of stretch-wrap film on cores which do not extend significantly out of the film roll, and can be removed therefrom for reuse.

It is another object and advantage of this invention to provide a pair of identical reusable and insertable handles, each of which has a substantially rigid hand grip thereon so that the two handles can be employed to guide the stretch-wrap film roll during wrapping, and the hand grips can be grasped in the gloved hand to control film tension during wrapping by squeezing the hand.

It is another purpose and advantage of this invention to provide a reusable insertable handles for stretch-wrap rolls wherein the core does not extend significantly out of the film roll, with the handles being of sturdy construction but of economic construction so that they can be widely employed wherever manually controlled stretch-wrapping is convenient.

The features of the present invention which are believed to be novel are set forth with particularity in the appended claims. The present invention, both as to its organization and manner of operation, together with further objects and advantages thereof, may be best understood by reference to the following description, taken in conjuction with the accompanying drawings.

BRIEF DESCRIPTION OF THE DRAWINGS

FIG. 1 is an isometric view of the reusable insertable one-piece handles of this invention in connection with a stretch-wrap film roll.

FIG. 2 is an enlarged side-elevation view of one of the handles, with parts broken away and parts taken in centerline section.

FIG. 3 is an end elevational view of one of the handles in a core, with parts broken away and parts taken in section.

FIG. 4 is a partial view, with parts broken away and parts taken in section of the interengagement between the handle and film core during insertion of the handle.

FIG. 5 is similar to FIG. 4, showing the deflections during withdrawal of the handle. In both of these figures, the full line shows the position of the handle without the respective application of axial insertion and removal forces, while the dashed lines show the deflections caused by the respective axial insertion and removal forces.

DETAILED DESCRIPTION OF THE PREFERRED EMBODIMENT

The reusable insertable handles of this invention are particularly for use with rolls of stretch-wrap film. Film 10 is wound on core 12 which is in the form of a circular cylindrical tube, usually made of cardboard material. As is indicated in FIGS. 2 and 4, the film and core are generally coextensive in the axial direction. Therefore, there is insufficient core extending out from the wound roll of film for the attachment of handles to the exterior of the core. Instead, in accordance with this invention, the reusable handle is insertable into the core. Handle 14 is illustrated in FIGS. 1, 2 and 3. Handle 20 is shown in FIG. 1 on the opposite end of film roll 10 and is identical to handle member 14.

In order to provide eceonomic construction of the reusable insertable handle, it is configured to be economically shaped by vacuum-molding or blow-molding of thermoplastic synthetic polymer composition material. As is seen in detail in FIG. 2, handle 14 (and identical handle 20) has flat circular face 22. Face 22 has six equispaced radial ribs thereon, two of which are indicated at 24 and 26. At its outer periphery, face 22 is joined by a small radius to circular cylindrical tubular plug 28 so that the face closes the plug and provides radial strength to the plug at its left end. The outer diameter of circular plug 28 is smaller than the interior circular cylindrical surface 30 of core 12 so that the plug would freely insert therein if it were only for the circular cylindrical outer surface of the plug. That surface terminates on its right end on ring 32, which acts as an insertion stop to limit the depth at which the plug can be inserted into the core. Ribs 34 and 36 are seen in both FIGS. 2 and 3 and have two functions. As is seen in FIG. 3, there are six ribs, each in alignment and joining the ribs on face 22 equally spaced, but since each has the same structure and function, only two need be indicated and described. Each of the ribs extends out from the wall of circular plug 28, preferably in the form of a half circular tube, as seen in FIG. 3. The wall of the ribs is the same as the wall of the plug. The outer diameter over the ribs is greater than the interior diameter of interior surface 30 of the core. Thus, in the unstressed condition, there is an interference fit between the ribs and the interior of the core. The ribs also serve to interrupt the otherwise continuous circular integrity of the wall of the plug so as to form accordion folds in that wall. The unstressed diameter of plug 28 can be reduced by squeezing in upon the ribs to slightly close the openness on the inside of the ribs. Thus, bending of the wall rather than circumferential compression permits reduction in diameter.

As is seen in FIG. 2, ring 32 does not have interruption by such ribs throughout and, thus, cannot circumferentially fold. The maintenance of the circular integrity of ring stop 32 is important to the manner in which the handle fucntions as it is inserted and removed from the core. Outboard of ring 32 is transition piece 38, which is a shallow conical piece having the same general wall thickness. It is in the form of a right circular cone.

Hand grip 16 is integrally formed with transition piece 38 at the smaller end of the cone. Hand grip 16 is a circular tubular structure with circular ribs 40, 42 and 44 formed on the exterior surface 46. The surface 46 terminates at the left end, as seen in FIG. 2, at the juncture with the transition piece 38. At its right end, the surface 46 terminates in neck 48.

It is seen that a strong reusable insertable handle is provided. However, the design has flexure which aids in insertion and removal of the handle, to make those acts relatively easy, while maintaining a tight fit of the handle within the core when no axial force is applied. It is believed that the flexure which achieves this desirable result comes about as follows. In FIG. 4, the relative motion between the handle 14 and core 12 is such as to insert the handle. This axial compression along the plug 28 causes relative rightward motion of plug 28 and its ribs with respect to ring stop 32. This is permitted because the conical left face 54 of the ring stop has the ribs 34, 36 and their companions adjoining thereto. This permits the conical face to swing to result in reduction in diameter of the circular plug 28 and the ribs thereon. This reduction in diameter eases insertion. Even with this reduced diameter, there is indentation of the interior surface 30 of core 12 by the ribs on the exterior of the plug 28, as seen in FIG. 4. Since the core is of cardboard material, such indentation is achieved without excessive force. The ribs around circular plug 28 permit accordion-folding in the circumferential direction so that the ribs can be squeezed down both by radial force from the core and by rotation of the conical wall 54 in the counter-clockwise direction as seen in FIG. 4. Neck 48 permits pounding on handle 14 to aid in handle insertion. When insertion is complete and the axial force is removed, the axial deflection of wall 54 caused by the axial force is recovered. This increases the diameter of the ribs to tightly engage within the core.

The mechanism which releases some of the engagement force of the ribs within the core upon removal stress is illustrated in FIG. 5. When rightward force is applied to hand grip 16, in the position shown in FIGS. 2 and 5, the center of transition piece 38 is urged to the right. This resiliently draws transition piece 38 into a more acute conical form. This pulling to the right of the center is illustrated in dashed lines in FIG. 5. Since the outer portion of ring stop 32 is uninterrupted by ribs which permit accordion deflection, ring stop 32 maintains its diameter. With an increase in conical shape, the ring stop 32 rotates in the counter-clockwise direction, under the force of the deflecting transition piece 38. This rotation draws the conical wall 54 in the counter-clockwise direction, as illustrated in FIG. 5, and this in turn reduces the diameter of circular plug 28 and the ribs carried thereon. This reduction in diameter of plug 28 and its ribs is thus achieved by the similar mechanism of rotating conical wall 54, but is achieved under different input stresses. By this construction, the insertable handle is more easily insertable and more easily removed, considering the amount of interference fit of the plug with the core, as compared to a solid insertable plug which does not have the benefit of hollow construction together with ribs which permit accordion circumferential flexure.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A reusable insertable one-piece handle for film rolls on a tubular roll core comprising:

a handle, said handle having a hand grip thereon with an outside surface of generally circular configuration, said hand grip being for direct grasp by the user and being sized for manual grasp by the user;

said handle having a plug unitarily formed thereon with ribs on said plug arranged in generally circular configuration, said ribs having an outside diameter larger than the opening in the tubular roll core into which it is to be inserted;

said handle including a transition piece between said plug and said hand grip and unitarily formed with said plug and said handle grip, said plug and said ribs being deflectable by stress applied thereto so that said ribs can be inserted into a roll core with indentation of the roll core, remain in engagement with the roll core during use and be withdrawn from the roll core without damage to said handle.

2. The reusable insertable one-piece handle of claim 1 wherein said transition piece is conical so that axial movement of said handle with resect to said plug causes deflection of said plug.

3. The reusable insertable one-piece handle of claim 2 wherein said handle is formed as a hollow body of flexible synthetic polymer composition material.

4. The reusable insertable one-piece handle of claim 3 wherein the wall thickness of said handle is substantially uniform.

5. The reusable insertable one-piece handle of claim 2 wherein said ribs are formed on a substantially cylindrical tubular plug and said plug and said ribs adjoin said transition piece at a ring stop which is of larger diameter than said ribs so that said ring stop acts as a stop against the end of the roll core upon insertion of said plug and said ribs into the roll core.

6. The reusable insertable one-piece handle of claim 5 wherein said transition piece is in the form of a hollow frusto-cone with said hand grip extending from said frustum and said ring stop is at the skirt of said cone where said cone of said transition piece adjoins said plug.

7. The reusable insertable one-piece handle of claim 6 wherein said plug has a face and there are radial ribs formed on said face of said plug.

8. The reusable insertable one-piece handle of claim 7 wherein the exterior surface of said hand grip is substantially in the form of a tubular circular cylinder, said hand grip having circular ribs thereon for manual grasp.

9. The reusable insertable one-piece handle of claim 8 wherein said hand grip is a substantially rigid tube so that it runs freely in the user's hand even with light manual grasp thereon.

10. The reusable insertable one-piece handle of claim 8 wherein there are two said handles, one for insertion into each end of the roll core for grasp by the user to provide rotative friction between the user's hand and said hand grip to provide unwinding tension of film on said roll core.

11. The reusable insertable one-piece handle of claim 2 wherein the exterior surface of said hand grip is substantially in the form of a tubular circular cylinder, said hand grip having circular ribs thereon for manual grasp.

12. The reusable insertable one-piece handle of claim 11 wherein said hand grip is a substantially rigid tube so that it runs freely in the user's hand even with light manual grasp thereon.

13. The reusable insertable one-piece handle of claim 12 wherein there are two said handles, one for insertion into each end of the roll core for grasp by the user to provide rotative friction between the user's hand and said hand grip to provide unwinding tension of film on said roll core.

14. A reusable insertable one-piece handle for rolls having tubular cores, said handle member being unitarily formed of flexible thermoplastic synthetic polymer composition material, said handle comprising a tubular plug, a conical transition piece and a hand piece, formed together substantially as a body of revolution around an axis;

said tubular plug having an outer cylindrical suface sized to fit within the opening in a tubular roll core, said plug having a plurality of axial ribs on said outer cylindrical surface thereof, said axial ribs extending to a circumscribing circle of a diameter larger than the diameter of the inside opening of the tubular roll core, said plug having a face closing the end of said plug, said face having substantially radial ribs thereon adjoining said axial ribs on said outer surface of said plug;

said conical transition piece joining said plug with a ring stop of larger diameter than said circumscribing circle, said ring stop being continuous without ribs therein so that said axial ribs on said plug are resilient by virtue of rib deflection and said ring stop resists circumferential deflection by virtue of its lack of ribs;

said hand grip adjoining said transition piece, said handle grip having a substantially circular cylindrical exterior surface for direct grasp by the user and having circular ribs thereon so that said handle can be inserted into one end of a roll core to guide and support the roll core.

15. The reusable insertable one-piece handle of claim 14 wherein said handle is unitarily formed of thermoplastic synthetic polymer composition material by blow-molding, a blow-molding neck formed on the outer end of said hand grip so that said blow-molding neck may be used to pound said handle into the core of a roll.

16. A reusable insertable one-piece handle for rolls having tubular cores, said handle being unitarily formed of thermoplastic synthetic polymer composition material, said handle comprising a tubular plug, a conical transition piece and a hand piece, formed together;

said tubular plug having an outer cylindrical surface sized to fit within a tubular roll core, said outer cylindrical surface defining an axis, said plug having a plurality of axial ribs on said outer cylindrical surface thereof, said axial ribs extending to a circumscribing circle of a diameter larger than the diameter of the inside opening of the tubular roll core, said plug having a face closing the end of said plug, said face having substantially radial ribs thereon adjoining said axial ribs on said outer surface of said plug;

said transition piece joining said plug with a ring stop of larger diameter than said circumscribing circle, said ring stop being continuous without ribs therein so that said axial ribs on said plug are resilient by virtue of axial rib deflection and said ring stop resists circumferential deflection by virtue of its lack of ribs, said ring stop being conical where it adjoins said plug so that axial thrust of said plug towards said axial ring stop causes reduction in diameter of said axial ribs aid in insertion of said handle into a roll core;

said hand grip adjoining said transition piece, said hand grip having a substantially circular cylindrical exterior surface having circular ribs thereon so that said handle can be inserted into one end of a roll core to guide and support the roll core.

* * * * *